United States Patent [19]

Klein

[11] 4,394,038

[45] Jul. 19, 1983

[54] ADHESIVE-BACKED BOOKLET FOR CREDIT CARD TRANSACTION

[76] Inventor: Paul E. Klein, 601 First St., Lake Oswego, Oreg. 97034

[21] Appl. No.: 223,854

[22] Filed: Jan. 9, 1981

[51] Int. Cl.[3] ..... G09F 3/10

[52] U.S. Cl. ..... 282/1 R; 282/DIG. 2; 283/81; 101/269

[58] Field of Search ..... 101/269; 282/1 R; 283/20, 21

[56] References Cited

U.S. PATENT DOCUMENTS

| | | | |
|---|---|---|---|
| 2,139,377 | 12/1938 | Mull et al. | 40/2 |
| 2,253,917 | 8/1941 | Rogers | 282/9 |
| 2,323,342 | 7/1943 | McManus et al. . | |
| 2,506,015 | 5/1950 | Doepke | 282/24 |
| 3,003,415 | 10/1961 | Herbert, Jr. | 101/269 |
| 3,272,532 | 9/1966 | Owen | 283/20 |
| 3,290,061 | 12/1966 | Glassman | 282/1 R X |
| 4,004,058 | 1/1977 | Buros et al. | 283/21 X |
| 4,029,341 | 6/1977 | Neill et al. | 282/1 R X |
| 4,159,129 | 6/1979 | Lockhart | 282/27 |

*Primary Examiner*—Paul A. Bell
*Assistant Examiner*—John S. Brown
*Attorney, Agent, or Firm*—Kolisch, Hartwell & Dickinson

[57] ABSTRACT

A credit-card-adhering transaction record for use with credit cards and an imprinting device having a defined region for receiving a card on a support surface, and a pressure platen manipulatable relative to the surface. The transaction record includes a plural-detachable-sheet recording booklet including a customer-return sheet. A stretch of the customer-return sheet is directly placeable on the support surface so that it has an expanse extending over a portion of a card received in the defined region of the support surface. An exposable pressure-responsive adhesive film distributed over the expanse of the sheet-captures and releasably retains the credit card following an imprinting operation.

5 Claims, 7 Drawing Figures

ADHESIVE-BACKED BOOKLET FOR CREDIT CARD TRANSACTION

BACKGROUND AND SUMMARY OF THE INVENTION

This invention pertains to a transaction record, and more specifically to a credit transaction record for use with a credit or other card and an imprinting device.

During a typical sales transaction, a customer will give to the sales clerk his or her credit card. The card is placed in a defined region on a support surface of an imprinting device. The clerk then takes a credit transaction recording booklet, generally prepared specifically for the particular credit card being used, and places it on a second defined region of the support surface positioned so that an expanse of the booklet overlaps the card. A pressure platen or equivalent part of the imprinting device is moved over the record and card, causing the information existing on the card in the form of raised characters to be imprinted on the record. After removing the record from the imprinting device, specific details of the immediate sales transaction are recorded manually by the sales clerk. The customer signs the record acknowledging completion of the transaction as recorded, and returns the record to the sales clerk. A "customer's copy" sheet of the record is torn from the booklet and given to the customer. Additionally, the credit card is removed from the imprinting device and returned to the customer.

The preceeding description relates to a credit card transaction as it is usually performed. However there are times when the customer leaves without taking his or her credit card. This happens when the clerk forgets to remove the card from the imprinting device, or otherwise forgets to return it to the customer. Also, a customer, involved with gathering his or her purchases and receipt, often leaves the card lying on the counter.

It is therefore a general object of this invention to provide means for reducing the likelihood of customers leaving their cards following a credit transaction.

Specifically, it is an object to provide a credit transaction record having means for releasably adhering the card to the customer's copy of the transaction record.

The preferred embodiment of the disclosed invention is intended for use with conventional credit cards having raised characters, and an imprinting device having a defined region for receiving such a card on a support surface, and a pressure platen manipulatable relative to the surface. A transaction record made in conformance with this invention includes a plural-detachable-sheet recording booklet including a customer-return sheet. A stretch of the sheet is directly placeable on the support surface so that it has an expanse extending over a portion of a card received in the defined region of the support surface. A pressure-responsive adhesive film is distributed over the expanse of the sheet, and is covered by a removable backing sheet.

During a credit card transaction, the backing sheet is peeled off—exposing the adhesive film. The transaction record is then placed in an imprinting device in receipt of a credit card. A conventional imprinting operation is then performed causing the card to be captured by the sheet and releasably retained thereon.

It can therefore be seen that a transaction record made in conformance with this invention will provide a means for assuring that the credit card will be returned with the customer's copy of the credit receipt.

These and additional objects and advantages of the present invention will be more clearly understood from a consideration of the drawings and the detailed description of the preferred embodiment.

DETAILED DESCRIPTION OF THE INVENTION

Figure 1:
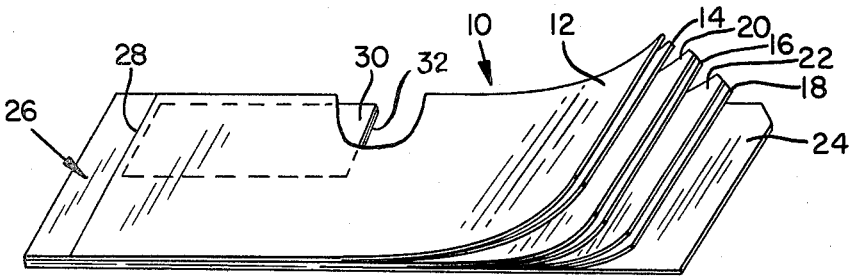
FIG. 1 shows a fragmentary perspective view of a transaction record made in conformance with this invention taken from the top lower right corner.

Referring now to FIG. 1, the preferred embodiment of this invention is a credit transaction record, shown generally at 10, which includes a booklet having a plurality of sheets. A top sheet 12 generally provides information identifying the booklet and instructions on its use, and further provides protection for underlying sheets. Carbon sheets 14, 16, 18 provide means for imprinting information impressed on one sheet on the other sheets. An imprintable sheet 20, interposed between carbon sheets 14, 16, is typically a copy which is forwarded to the financing institution. A seller's copy 22 is positioned between carbon sheets 16, 18. The last page is a customer-return sheet, 24, positioned below carbon sheet 18. Sheet 24 is also referred to herein as a recording sheet. Sheets 12, 14, 16, 18, 20, 22, 24 are bound at an end 26 and are detachable along line 28, thereby forming a plural-detachable-sheet recording booklet.

Figure 2:
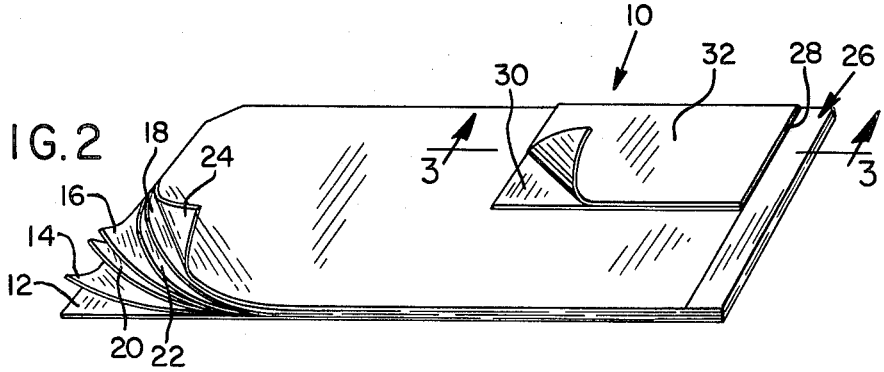
FIG. 2 shows a perspective view taken from the rear upper left of FIG. 1.

Still considering FIG. 1, a pressure-responsive adhesive film 30, also referred to herein as pressure-responsive adhesive means, is distributed over an expanse of the back of sheet 24. Referring to FIG. 2 along with FIG. 1., film 30 is exposably covered by a backing sheet 32.

Figure 3:
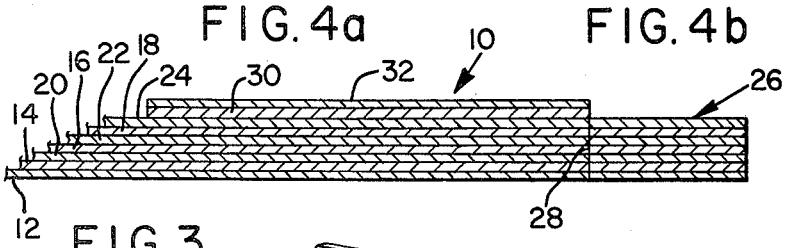
FIG. 3 is an enlarged fragmentary cross-sectional view taken along line 3—3 of FIG. 2.

FIG. 3 shows clearly the layering of sheets 12, 14, 16, 18, 20, 22, 24, and the relative positioning of adhesive film 30 and backing sheet 32 on sheet 24.

Figure 4A:
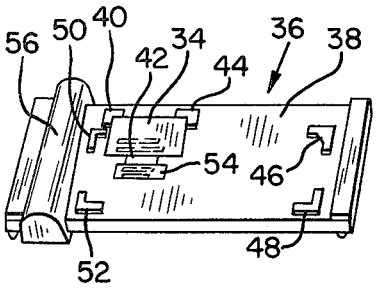
FIG. 4 shows a sequence of perspective views portraying activities involved in imprinting credit card information on a transaction record with an imprinting device.

Referring to FIG. 4*a*, transaction record 10, as contemplated herein, is intended for use with credit transaction recording agencies such as a credit card 34 having a raised characters, and a conventional imprinting device shown generally at 36. Typically, device 36 has a support surface 38 with a region for receiving such a card defined by keepers 40, 42, 44. Additionally, a region defined by keepers 46, 48, 50, 52 is for receiving record 10. The card receiving region and record receiving region overlap in a defined expanse. This is necessary in order to be able to imprint the information contained on the credit card on the sheets.

Support surface 38 carries a plate 54 mounted thereon also having raised characters for imprinting additional information on record 10. Device 36 further includes a pressure platen 56 positioned above surface 38 and movable thereover.

Figure 4B:
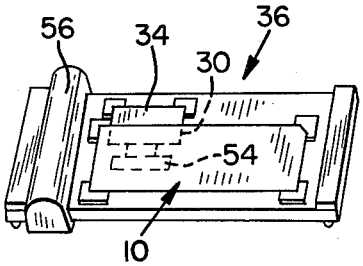

Explaining a credit transaction, and continuing to refer to FIG. 4*a*, credit card 34 is placed in the card receiving region of surface 38. Backing sheet 32 is peeled away from adhesive film 30 on a record 10, and the record is placed within the record-receiving region of surface 38, such that the face of the expanse of sheet 24, having now-exposed adhesive film 30, extends over a portion of card 34, as shown in FIG. 4*b*. The entire sheet 24, being placed on surface 38, is also referred to herein as a stretch of sheet 24 directly placeable on such a surface.

Figure 4C:
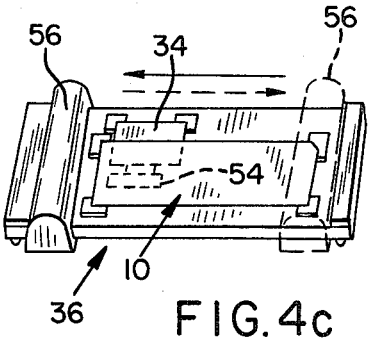

Platen 56 as shown in FIG. 4*a*, is normally stored, when not in use, on the left side of device 36. After insertion of card 34 and record 10, platen 56 is slid from left to right as shown by the dashed arrow in FIG. 4*c* until platen 56 reaches the right end of device 36, as shown by the dashed line represenation of platen 56. It is returned to its original position on the left end of device 36 as shown by the solid arrow in FIG. 4*c*. Platen 56 has a pressure-applying surface or roller which causes the information from credit card 34 and plate 54 to be imprinted on sheets 20, 22, 24. Also during this operation, card 34 is captured by adhesive film 30 so that it is releasably retained on sheet 24.

Figure 5:
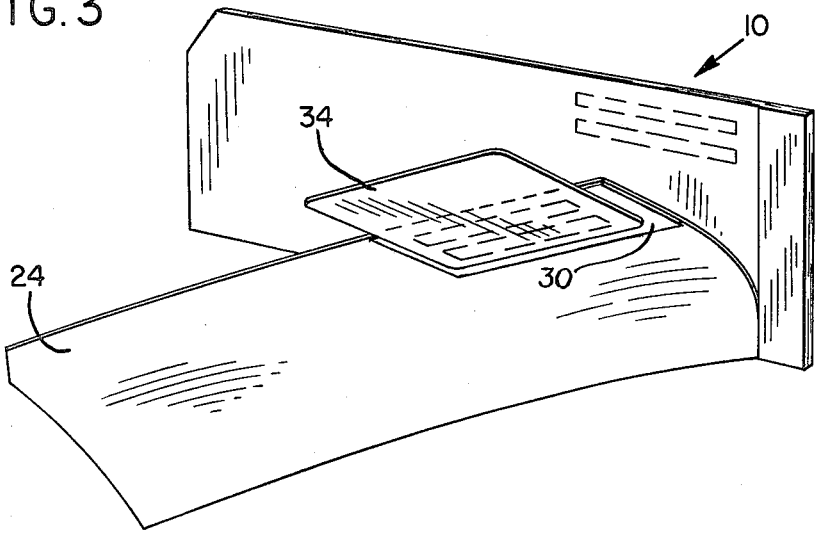
FIG. 5 is a perspective view of the back of a transaction record following an imprinting operation showing the customer-return sheet partially removed from the transaction record and releasably retaining a credit card.

After the imprinting operation has been performed, the sales clerk enters the transaction information in the record which is then signed by the customer. Finally, sheet 24, retaining credit card 34, is detached from record 10, as shown in FIG. 5 and given to the customer.

Having simultaneously received both credit card 34 and customer-return sheet 24, the customer will remove card 34 for future use.

It can be seen that a transaction booklet made in conformance with this invention provides a means which assures return of a customer's credit card during each transaction, so long as the customer-return sheet is given to the customer. Thus, it is not necessary to remember specifically that the credit card must be returned.

While a preferred embodiment of the invention has been described herein, it is appreciated that variations and modifications may be made without departing from its spirit. Examples could include changes in size, number of sheets included in the booklet, different ways of adhering a card to the sheet and variations in the imprinting technique which impact the record design.

It is claimed and desired to secure by Letters Patent:

1. In combination a transaction record including a card having print-impartible characters, and an imprinting device having a support surface with a defined region for receiving such a card, and a pressure platen cooperative with such surface and manipulatable relative thereto to effect an imprinting operation, said record being imprintable and, comprising a recording sheet placeable on said surface, said sheet having a defined expanse disposed to extend, when said sheet is placed on said surface, over at least a portion of a card received by such defined region, and pressure-responsive adhesive means distributed over the expanse face placeable adjacent said card for capturing and releasably retaining with said sheet said card following an imprinting operation.

2. In combination a transaction record including a card having print-impartible characters, and an imprinting device having a support surface with a defined region for receiving such a card, and a pressure platen cooperative with said surface and manipulatable relative thereto to effect an imprinting operation, said record being imprintable and, comprising a plural-detachable-sheet recording booklet including one sheet having a stretch directly placeable on said surface, said stretch having a defined expanse disposed to extend, when said sheet is placed on said surface, over at least a portion of a card received by said defined region, and pressure-responsive adhesive means distributed over the expanse face placeable adjacent said card for capturing and releasably retaining with said one sheet said card following an imprinting operation.

3. In combination a transaction record including a card having print-impartible characters, and an imprinting device having a support surface with a defined region for receiving said card, and a pressure platen cooperative with such surface and manipulatable relative thereto to effect an imprinting operation, said record being imprintable and comprising a recording sheet placeable on said surface, said sheet having a defined expanse disposed to extend, when said sheet is placed on said surface, over at least a portion of a card received by such defined region, and pressure-responsive exposably covered adhesive means distributed over the expanse face placeable adjacent said card and exposable for capturing and releasably retaining with said sheet such a card following an imprinting operation.

4. In combination a transaction record including a card having print-impartible characters, and an imprinting device having a support surface with a defined region for receiving said card, and a pressure platen cooperative with said surface and manipulatable relative thereto to effect an imprinting operation, said record being imprintable and, comprising a plural-detachable-sheet recording booklet including one sheet having a stretch directly placeable on said surface, said stretch having a defined expanse disposed to extend, when said sheet is placed on said surface, over at least a portion of a card received by such defined region, and pressure-responsive exposably covered adhesive means distributed over the expanse face placeable adjacent said card and exposable for capturing and releasably retaining with said one sheet said card following an imprinting operation.

5. In combination a transaction record including a credit card having print-impartible characters, and an imprinting device having a support surface, with a defined region for receiving said card, and a pressure platen cooperative with said surface and manipulatable relative thereto to effect an imprinting operation, said record being imprintable and, comprising a plural-detachable-sheet recording booklet including a customer-return sheet having a stretch directly placeable on said surface, said stretch having a defined expanse disposed to extend, when said sheet is placed on said surface, over at least a portion of a credit card received by said defined region, and pressure-responsive adhesive means distributed over the expanse face placeable adjacent said card for capturing and releasably retaining with said customer-return sheet said card following an imprinting operation.

* * * * *